US012209370B2

(12) United States Patent
Royce

(10) Patent No.: US 12,209,370 B2
(45) Date of Patent: Jan. 28, 2025

(54) PREFABRICATED PRECOMPRESSED DECK JOINT SYSTEMS

(71) Applicant: Mathew Chirappuram Royce, Fredericksburg, VA (US)

(72) Inventor: Mathew Chirappuram Royce, Fredericksburg, VA (US)

( * ) Notice: Subject to any disclaimer, the term of this patent is extended or adjusted under 35 U.S.C. 154(b) by 836 days.

(21) Appl. No.: 17/246,387

(22) Filed: Apr. 30, 2021

(65) Prior Publication Data

US 2022/0349133 A1 Nov. 3, 2022

(51) Int. Cl.
*E01D 19/06* (2006.01)

(52) U.S. Cl.
CPC ..... *E01D 19/067* (2013.01)

(58) Field of Classification Search
CPC ..... E01D 19/067; E01D 19/06; E01D 21/00; E01D 2/00; E01D 2/02
See application file for complete search history.

(56) References Cited

U.S. PATENT DOCUMENTS

| | | | | |
|---|---|---|---|---|
| 4,604,841 | A * | 8/1986 | Barnoff | E01D 2/02 52/379 |
| 5,771,518 | A * | 6/1998 | Roberts | E01D 19/02 14/73.1 |
| 9,551,119 | B2 * | 1/2017 | Tirimanna | E01D 15/133 |
| 10,895,047 | B2 * | 1/2021 | Nelson | E01D 2/00 |
| 2006/0117504 | A1 * | 6/2006 | Ronald | E01D 21/06 14/73 |
| 2012/0222375 | A1 * | 9/2012 | He | E04B 5/10 52/223.7 |
| 2014/0137492 | A1 * | 5/2014 | French | E04C 2/06 52/223.6 |
| 2021/0363711 | A1 * | 11/2021 | He | E01D 19/125 |

* cited by examiner

*Primary Examiner* — Abigail A Risic
(74) *Attorney, Agent, or Firm* — PATENT PORTFOLIO BUILDERS PLLC

(57) ABSTRACT

This invention is the concept and method of designing, fabricating in a factory environment and installing Deck Joint Systems (DJS) consisting of Ultra High Performance Concrete (UHPC) joint headers sandwiching the joint sealer and pre compressing the sealer using a plurality methods for applying compression. The deterioration of bridges due to the exposure to chlorides, most commonly from leaking joints, has been established as the biggest challenge for bridge owners in the US and abroad. In general, the lack of performance of deck joint systems constructed using state of the art practices is causing accelerated bridge deterioration, especially in areas where deicing chemicals are used.

8 Claims, 10 Drawing Sheets

PREFABRICATED PRECOMPRESSED DECK JOINT SYSTEMS

BACKGROUND OF THE INVENTION

Field of the Invention

The present invention is related to bridge deck joint systems; particularly this disclosure is regarding methods of designing, manufacturing and installing Prefabricated Deck Joint Systems (DJS) comprising of Ultra High Performance Concrete (UHPC) joint headers combined with joint seal, compressed using a plurality of devices and methods so that the joint seal will be in a state of compression all through the temperature cycle in the installed condition.

Description of Prior Art

State of the art for constructing Deck Joint System is by casting-in-place concrete headers along the terminations of decks at the joint locations and subsequently inserting the joint seals to fill the open space between the headers after the header concrete has reached sufficient strength and maturity.

The state of the art method of constructing Deck Joint Systems will require multiple field operations such as constructing the form work for the headers, casting header concrete, removing formwork, cleaning the header surfaces and placing and curing joint seals resulting in a long construction duration.

In the state of the art method joint seals are inserted into the openings between the concrete headers in the field where the level of compression induced into the seal cannot be monitored or controlled.

The state of the art method of constructing Deck Joint Systems often has lower than required level of compression at the time of installation. The most common mode of joint failure is the separation of the seal from the header concrete due to tension in the seal when joint openings are at their widest. This happens when the bridge superstructures are at the lower end of the ambient temperature range. The separation of the seal from the headers generally results in leakage of deck drainage through the joint.

Another mode of joint failure is the crushing of the joints seal which occurs at the expanded state of the superstructure if the seal has more than required compression at the time of installation. This failure mode could result in leakage through the joints.

Most joints built using state of the art methods fail soon after construction due to the inherent inadequacies of field installation of joint seals. The inadequacies include the presence of moisture and/or undesirable materials on the connecting surfaces, undesirably low or high temperatures at the time of application of the bonding chemical and the uncontrolled temperature ranges during the curing of the bonding chemical.

The tendency for separation of the seal from the headers is further aggravated when the bond between the seal and headers are inadequate.

The second most commonly occurring mode of joint failure of deck joints is the cracking of the joint header and the deck concrete around the headers. The state of the art practices is casting in place concrete headers using conventional concrete or other types of concrete with low tensile strength and toughness.

Cracking of joint headers within a short period of time after construction is a well documented common occurrence especially in joints on bridges with high levels of truck traffic as well as on bridges that are highly flexible under live loads.

The concrete headers constructed using the state of the art method routinely crack if the joints are exposed to heavy wheel loads.

The cracking of headers are further exacerbated if support of the joint from the bridge superstructure is inadequate, mainly due to the deterioration of the supporting steel member below the joints.

The cracking and deterioration of the headers can accelerate when cast-in-concrete has only limited cure time and inadequate control of the curing environment which is oftentimes the case for expedited joint replacement projects.

Consequences of Joint Failure

All failed joints leak run off water from the deck and onto the superstructure and substructure of the bridge underneath them, this leakage typically has a high concentration of deicing chemicals in areas where such chemicals are used in the winter months.

The deterioration of bridges due to the exposure to chlorides, most commonly from leaking joints, has been established as the biggest challenge for bridge owners in the US and abroad, In general, the lack of performance of deck joint systems constructed using state of the art practices is causing accelerated bridge deterioration, especially in areas where deicing chemicals are used.

SUMMARY OF THE INVENTION

This invention is the concept and method of designing, fabricating in a factory environment and installing Deck Joint Systems (DJS) consisting of Ultra High Performance Concrete (UHPC) joint headers sandwiching the joint sealer and pre compressing the sealer using a plurality methods for applying compression. The invention is capable of overcoming the major shortcomings of the prior art identified in this disclosure.

Figure 1:
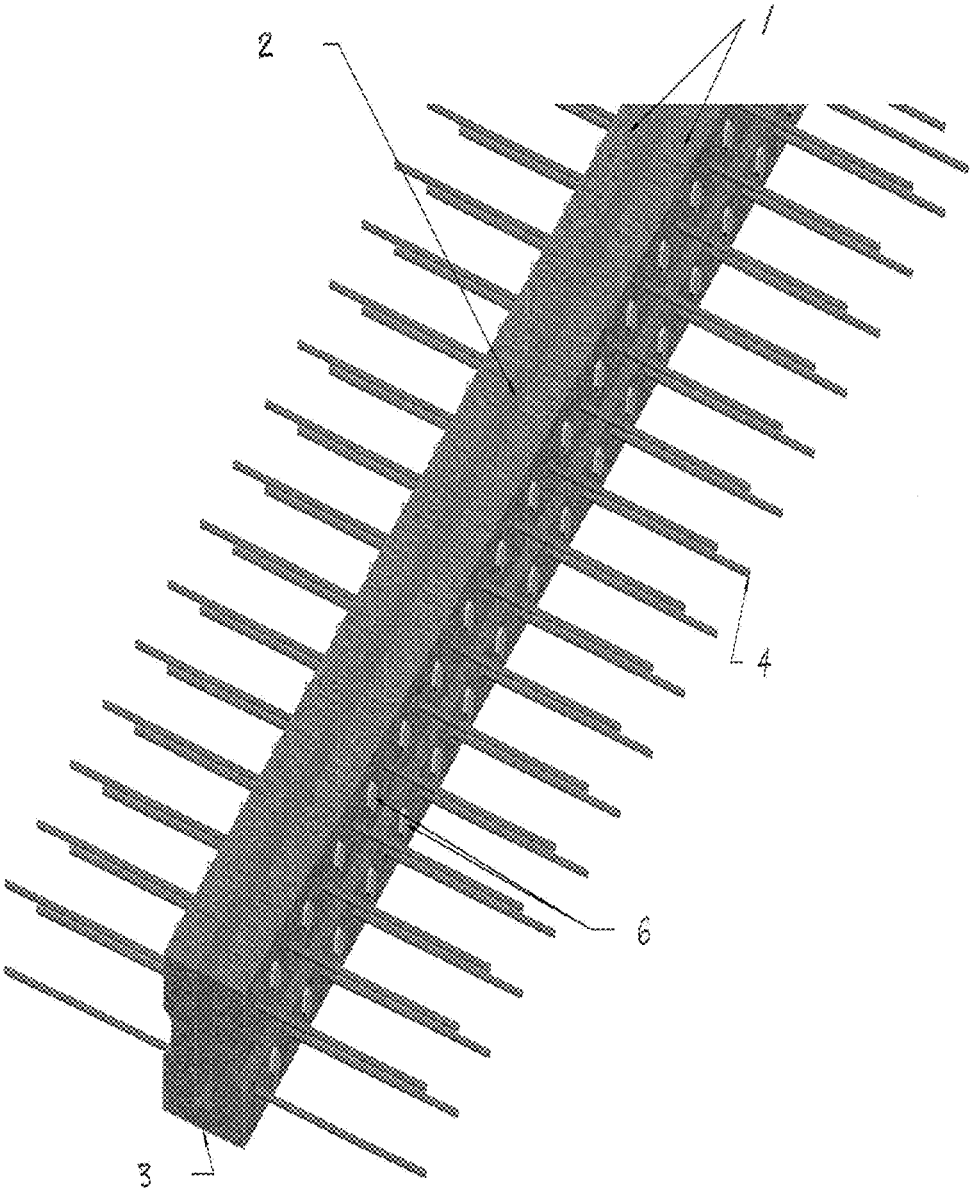
FIG. 1 is a representation of a 3 dimensional digital model of the preferred first embodiment of the present invention prior to its incorporation into a bridge deck or any other applicable structure.

The explanation provided below is applicable to all figures except when stated otherwise.

The depicted geometry of the components of the embodiment is for illustration of its description and shall not be regarded as limiting.

Joint Headers (1) are fabricated using Ultra High Performance Concrete (UHPC) to suitable shape to meet the needs of the specific application.

Joint Seal (2) of a varying size, shape and material composition designed based on the bridge type, geometry, superstructure type for each specific application, placed in between the Joint Headers (1) and connected by mechanical means as well as chemical bonding between the Seal and the Headers.

Bottom blocking (3) is compressible blocking near to the bottom of the gap between the Joint Headers (1) as one means of distribute the compressive stress uniformly through the depth of Joint Seal (2)

The combination of the compression bolt (5) and nuts (6) is a device for imparting or adjusting compression by tightening or loosening the nuts (6) prior to the installation of the joint system. The bolting system is designed and fabricated to apply a computed level of pre compression based on the bridge type, geometry, superstructure type, temperature at the time of installation, and the design temperature range applicable for the specific bridge.

Deck reinforcement (7) is placed in a new deck during deck construction or retained as part of the existing during a joint replacement project.

DETAILED DESCRIPTION OF THE EXEMPLARY EMBODIMENTS

This invention is the concept and method of designing, fabricating in a factory environment and installing Deck Joint Systems (DJS) comprising of Ultra High Performance Concrete (UHPC) joint headers sandwiching the joint sealer and pre compressing the sealer using a plurality methods of applying compression. The invention is capable of overcoming the major shortcomings of the prior art identified in this disclosure.

All descriptions herein with reference to the figures are not limiting and can be understood as features of varying details of the presented embodiment. The features, components, elements and/or aspects of the illustrations can be reorganised, resequenced and/or interchanged with other materials without effectively departing from the disclosed invention. The geometry of the components are also exemplary and can be altered without effectively affecting or limiting the disclosed invention.

The drawings and associated descriptions of the preferred embodiment of the invention shall be treated as an example and is intended for making the invention readily apparent to those with ordinary skill in the art. The presentation of the preferred embodiment of the invention shall not be regarded as limiting since the invention is capable of other embodiments and can be practiced or carried out multiple ways.

Prefabricated precompressed Deck Joint Systems (PPDJS) as per this invention are to be manufactured under a controlled environment under strict Quality Control and Quality Assurance procedures. This production method and the environment controls enables the use of materials with significantly better physical properties and durability characteristics and eliminates most of the negatives identified in the prior art construction method.

FIG. 1 Description.

FIG. 1 is a representation of a 3 dimensional digital model of the preferred first embodiment of the present invention prior to its incorporation into a bridge deck or any other applicable structure.

The size, shape and structural design of the Joint Headers (1) are dependent on specific application of this invention. The strength, toughness, functionality, crack resistance and corrosion resistance of these headers (1) are far superior to joint headers constructed using prior art methodology.

The size, shape, stiffness and compressibility of the Joint seal (2) are to be designed for each specific application based on the geometry of the bridge, its geographical location, amount of translatory movement of the superstructure to be accommodated in that joint.

Bottom Blocking (3) needed for enabling uniform distribution of compression within the Joint seal (2) is also designed for each specific application.

Reinforcing Bar Extensions (4) from the Joint Headers (1) are for connecting the PDJS to the bridge decks in the field by their embedment into a new or replacement deck or into a closure concrete pour between the Joint Headers (1) and the existing in a joint replacement application of this system.

Figure 2:
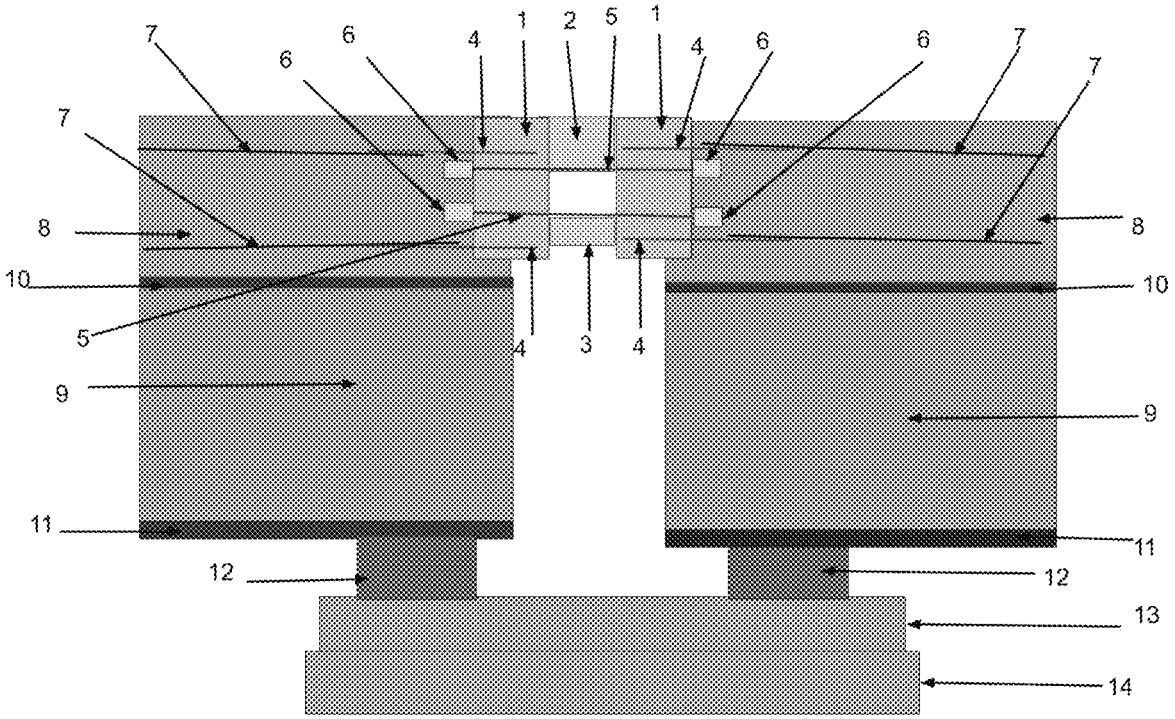
FIG. 2 is a sectional view of the preferred first embodiment of the invention as part of a bridge superstructure, taken perpendicular to the center lines of bearings at an intermediate support used in conjunction with the construction of new or replacement decks of adjacent spans.

Refer to FIG. 2 for the description of Compression Inducing Nuts (6)

FIG. 2 is a sectional view of PPDJS as part of a bridge superstructure, taken perpendicular to the center lines of bearings at an intermediate support used in conjunction with the construction of new or replacement decks of adjacent spans.

Refer to FIG. 1 for descriptions of 1, 2, 3, 4 and 6

Compression Bolts (5) are for inducing and adjusting compression in the Joint seal (2) by tightening or loosening the Compression inducing Nuts (6).

Longitudinal Deck Reinforcement (7) standard practice in the state of the art concrete deck construction.

Bridge Deck (8) is the conventional concrete bridge deck constructed using the state of the art bridge construction practices.

Steel Girder Web (9), Steel Girder Top Flange (10), Steel Girder Bottom Flange (11) are parts of a conventional steel bridge superstructure shown in this figure. An identical setup is applicable for a superstructure with concrete girders.

Bridge Bearings (12) supporting steel or concrete girders are routinely used in the state of the art practice in bridge construction.

Pedestals (13) and Bridge Seat (14) are parts of bridge substructure and are routinely used in the state of the art practice in bridge construction.

Figure 3:
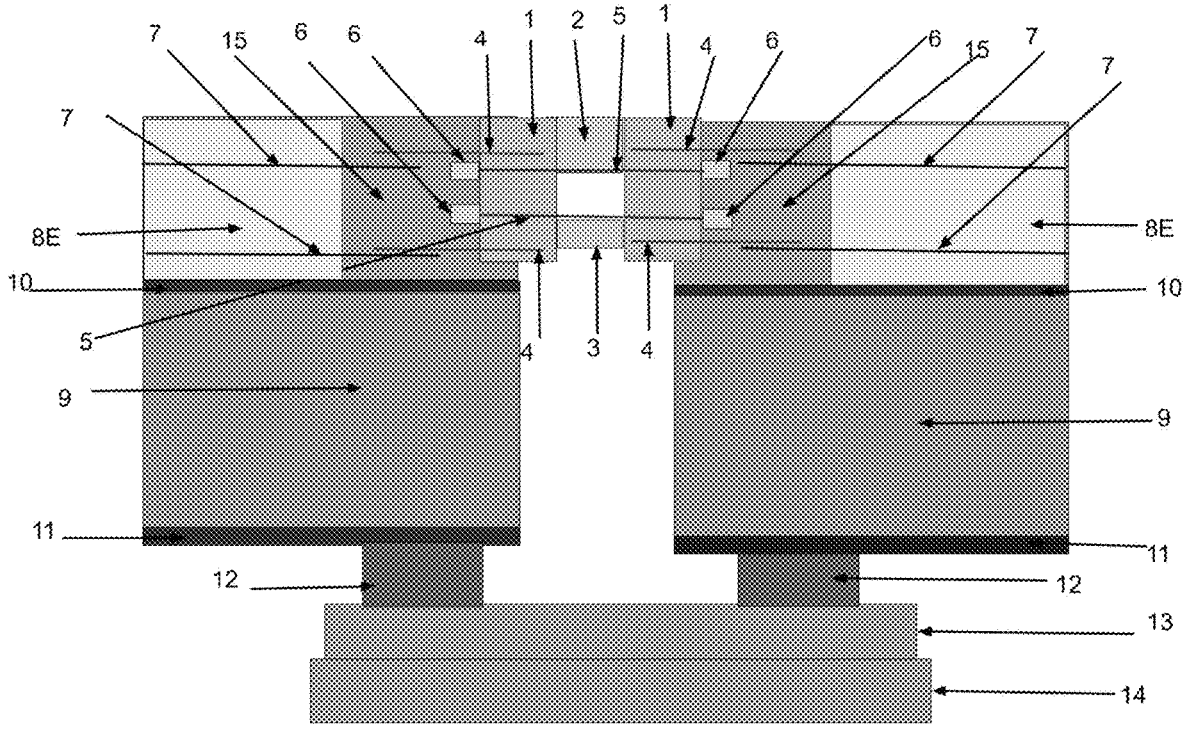
FIG. 3 is a sectional view of the preferred first embodiment of the invention as part of a bridge superstructure, taken perpendicular to the center lines of bearings at an intermediate support when used as the replacement of an existing bridge deck joint.

FIG. 3 is a sectional view of the preferred first embodiment of the invention as part of a bridge superstructure, taken perpendicular to the center lines of bearings at an intermediate support when used as the replacement of an existing bridge deck joint.

Refer to FIG. 1 and FIG. 2 for descriptions of 1,2,3,4,5, 6,7,9,10,11,12,13,14

Existing Deck (8E) is to be retained since PPDJS is used to replace an existing joint.

Closure Concrete (15) is the field placed connection of PPDJS with Existing Deck (8E)

Figure 4:
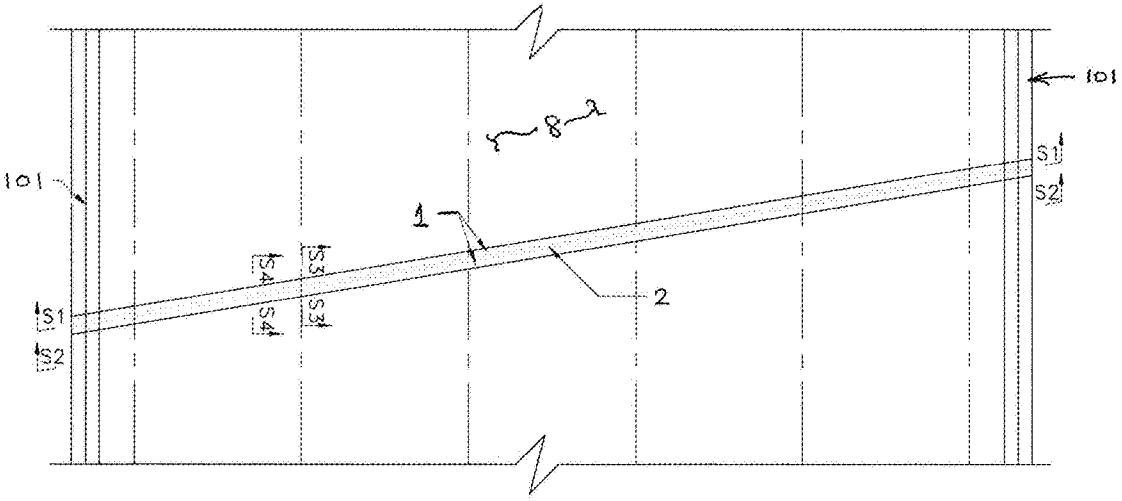
FIG. 4 is a plan view of the bridge deck incorporating the preferred first embodiment of the invention in conjunction with the construction of new or replacement decks of adjacent spans when the entire width of the deck is constructed in a single stage. Only the relevant part of the bridge deck near an intermediate support is presented.

FIG. 4 is a plan view of the bridge deck incorporating the preferred first embodiment of the invention in conjunction with the construction of new or replacement decks of adjacent spans when the entire width of the deck is constructed in a single stage. Only the relevant part of the bridge deck near an intermediate support is presented.

Refer to FIG. 1 and FIG. 2 for description for 1,2,8

Figure 5:
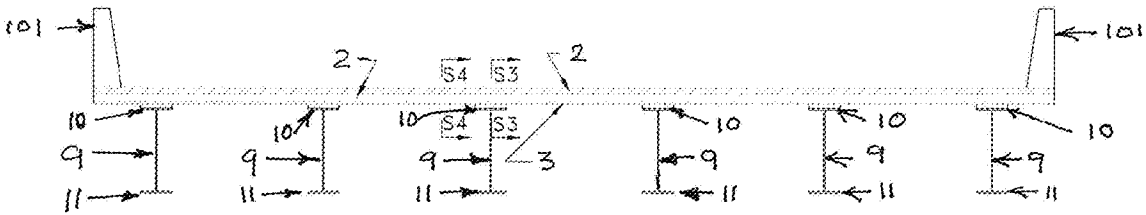
FIG. 5 is a sectional view of the bridge superstructure at location S1:S1 shown in FIG. 4.

Refer to FIG. 5 for section S1:S1

Figure 6:
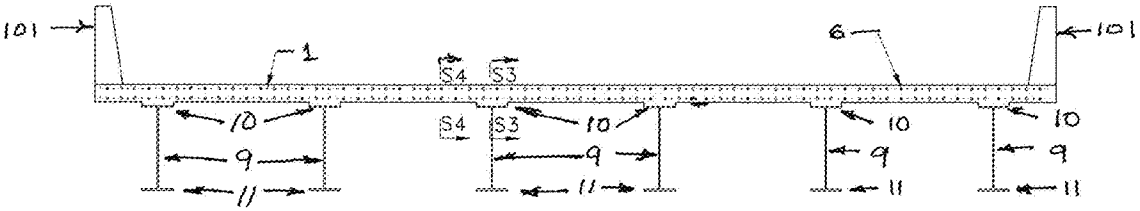
FIG. 6 is a sectional view of the bridge superstructure at location S2:S2 Shown in FIG. 4.

Refer to FIG. 6 for section S2:S2

Concrete Barrier (101) are parts of a conventional bridge superstructure shown in this figure.

Bridge Railing System is an alternate for Concrete Barriers'

FIG. 5 is a sectional view of the bridge superstructure at location S1:S1 shown in FIG. 4.

Refer to FIG. 1 and FIG. 2 for description for 1,2,3,9,10, 11.

Refer to FIG. 4 for description for 101.

FIG. 6 is a sectional view of the bridge superstructure at location S2:S2 Shown in FIG. 4.

Refer to FIG. 1 and FIG. 2 for descriptions of 4,6,7,9,10, 11

Refer to FIG. 4 for description for 101.

Figure 10:
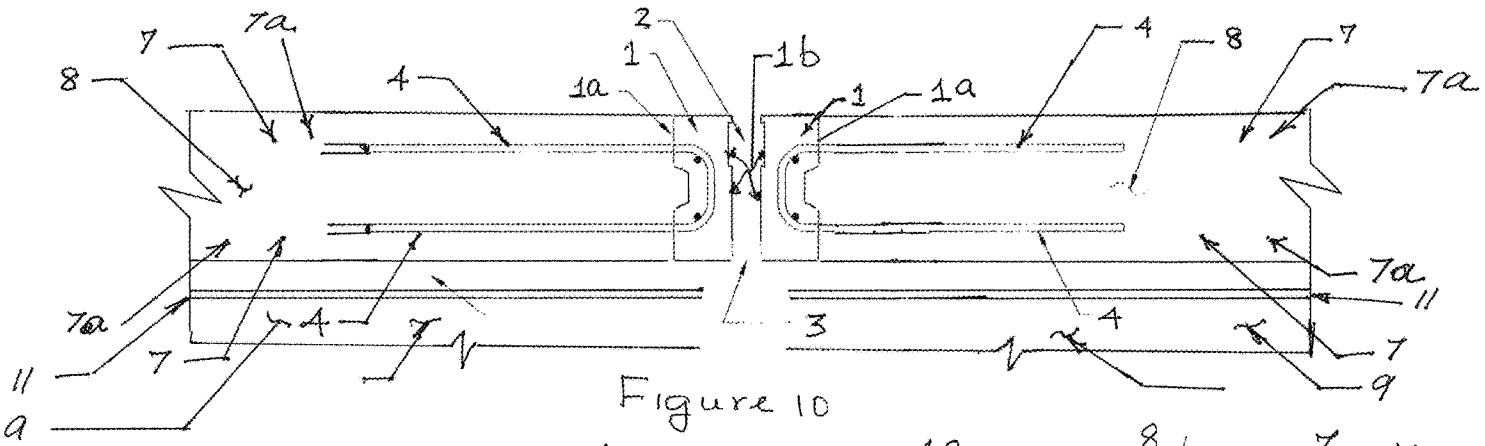
FIG. 10 is a sectional view of the bridge superstructure at location S3:S3, common for FIG. 6 and FIG. 9.

Refer to FIG. 10 for section S3:S3

Figure 11:
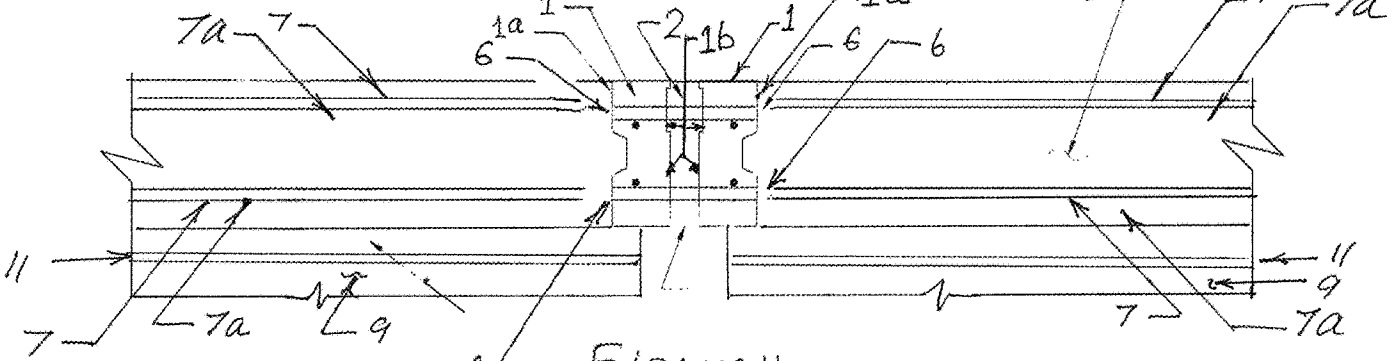
FIG. 11 is a sectional view of the bridge superstructure at location S4:S4, common for FIG. 6 and FIG. 9.

Refer to FIG. 11 for section S4:S4

Figure 12:
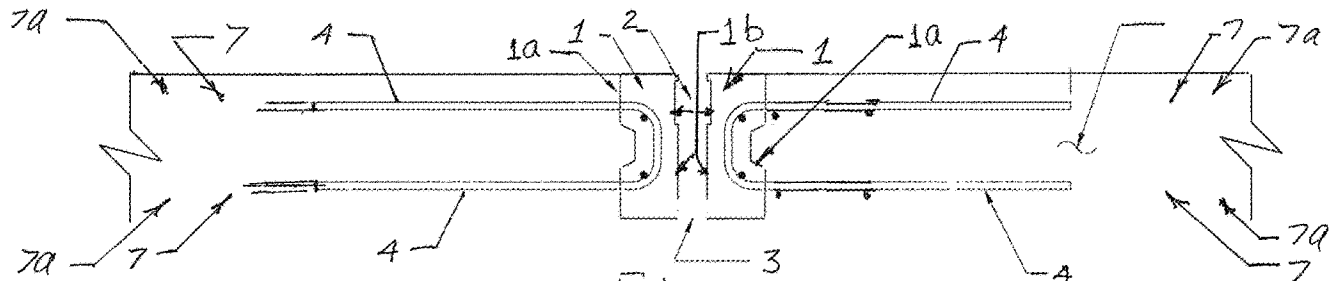
FIG. 12 is a sectional view of the bridge superstructure at location S5:S5, common for FIG. 6 and FIG. 9.

Refer to FIG. 12 for section S5:S5

Figure 7:
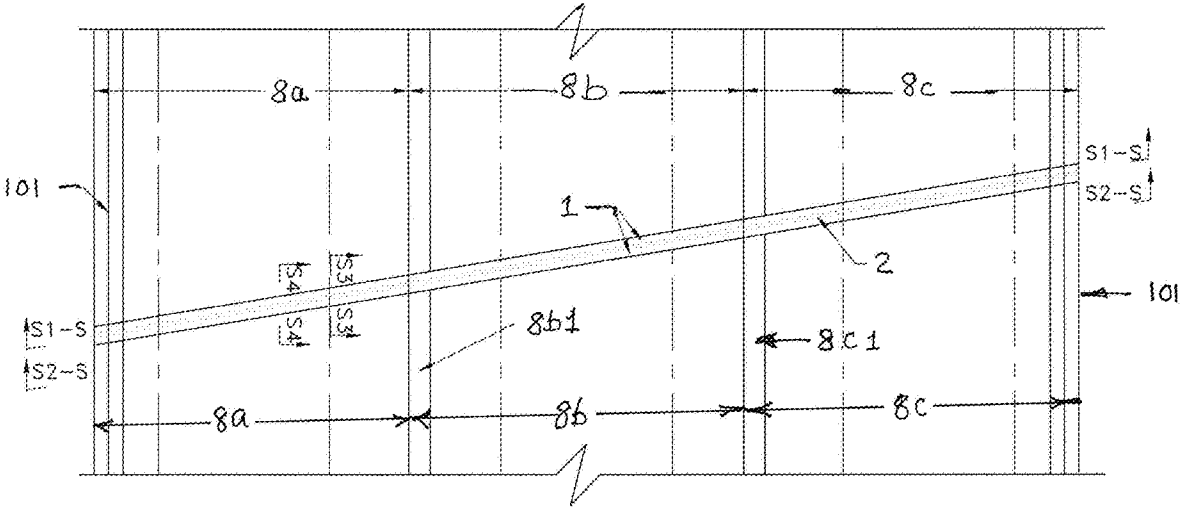
FIG. 7 is a plan view of the bridge deck incorporating the preferred first embodiment of the invention in conjunction with the construction of new or replacement decks of adjacent spans when the entire width of the deck is constructed in three stages. The presentation of a three stage construction sequence is exemplary, the applicability of this invention in a plurality of stages and sequences are implied. Only the relevant part of the bridge deck near an intermediate support is presented.

FIG. 7 is a plan view of the bridge deck incorporating the preferred first embodiment of the invention in conjunction with the construction of new or replacement decks of adjacent spans when the entire width of the deck is constructed in three stages. The presentation of a three stage construction sequence is exemplary, the applicability of this invention in a plurality of stages and sequences are implied. Only the relevant part of the bridge deck near an intermediate support is presented.

Refer to FIG. 1 and FIG. 2 for description for 1,2

Stage 1 Deck (8*a*), Stage 2 Deck (8*b*), Stage 3 Deck (8*c*) is the first, second and third stages of a 3 stage deck removal and replacement operation. Removal and replacement of existing deck in stages is routinely used in bridge rehabilitation to maintain traffic on an existing bridge during the rehabilitation operation. The number of stages employed and the sequence in which they are removed and replaced will change based on the needs of specific situations.

Closure pour (8*b*1), is the connecting pour between 8*a* and 8*b*

Closure pour (8*c*1) is the connecting pour between 8*b* and 8*c*

Figure 8:
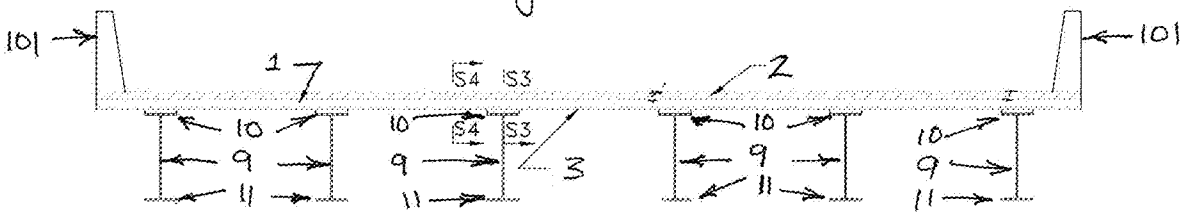
FIG. 8 is a sectional view of the bridge superstructure at location S1-S:S1-S shown in FIG. 7.

Refer to FIG. 8 for section S1-S:S1-S

Figure 9:
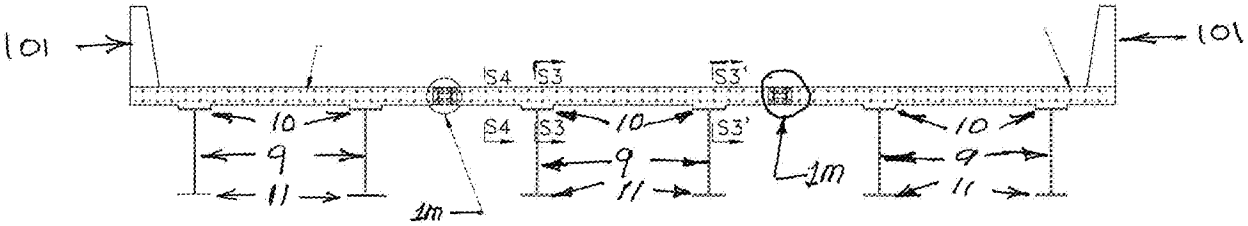
FIG. 9 is a sectional view of the bridge superstructure at location S2-S:S2-S shown in FIG. 7.

Refer to FIG. 9 for section S2-S:S2-S

FIG. 8 is a sectional view of the bridge superstructure at location S1-S:S1-S shown in FIG. 7.

Refer to FIG. 1 and FIG. 2 for description for 1,2,3,9,10, 11.

Refer to FIG. 4 for description for 101.

FIG. 6 is a sectional view of the bridge superstructure at location S2-S:S2-S Shown in FIG. 7.

Refer to FIG. 1 and FIG. 2 for descriptions of 4,6,7,9,10, 11.

Refer to FIG. 4 for description for 101.

Refer to FIG. 10 for section S3:S3

Refer to FIG. 11 for section S4:S4

Refer to FIG. 12 for section S5:S5

Figure 22:
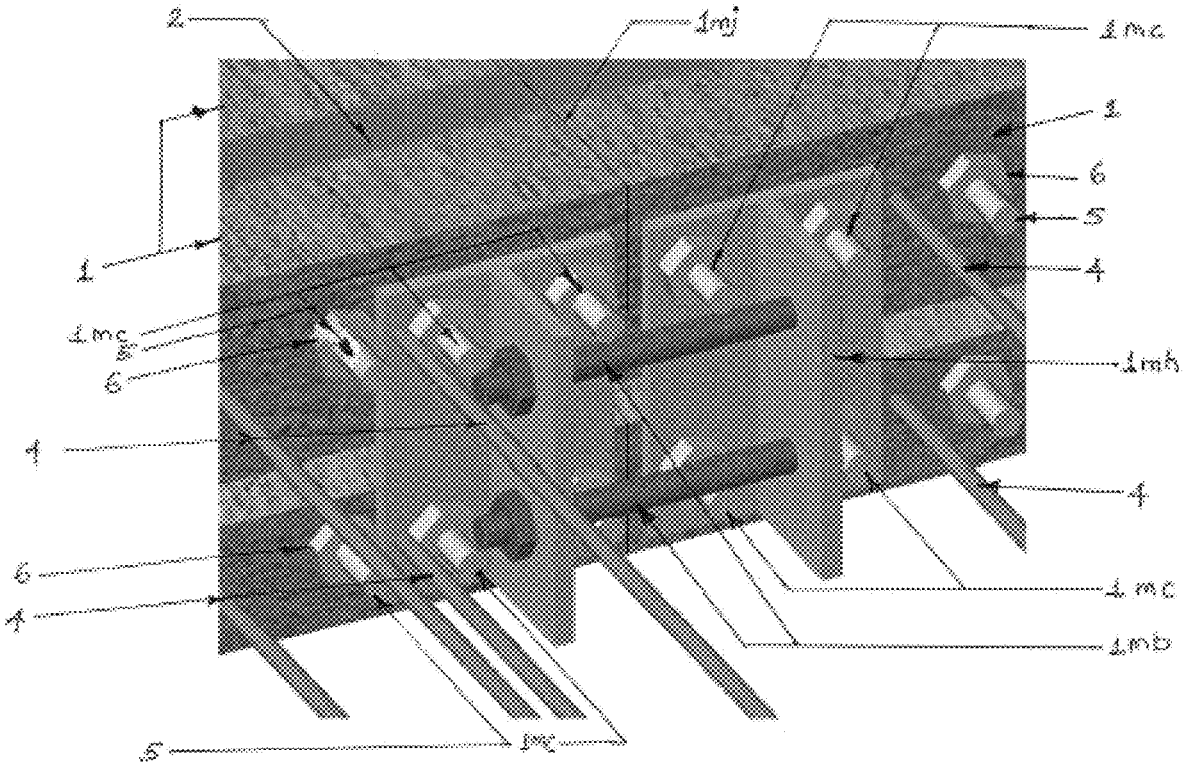
FIG. 22 is a detailed view of location 1*m* shown in FIG. 9 and FIG. 18.

Refer to FIG. 22 for detail of 1*m*

FIG. 10 is a sectional view of the bridge superstructure at location S3:S3 shown in FIG. 6 and FIG. 9, This section is taken at a vertical plane of Reinforcing Bar Extensions (4) over a girder top flange (10).

Refer to FIG. 1 and FIG. 2 for descriptions of 1,2,3,4,5, 6,7,9,10,11

Bonding Face (1*a*) is the face of (1) to be attached to the deck (8) with a surface preparation that will develop bond strength higher than the modulus of rupture of the deck (8) and a geometric shape capable of shear resistance between (1) and (8) higher than deck (8).

Bonding Face (1*b*) is the face of (1) to be attached to the joint seal (2) with a surface surface geometry that will develop mechanical interlocking of the joint seal (2) joint headers (1) and surface preparation that is capable of a strong and durable epoxy bond between seal (2) joint headers (1).

Deck Haunch (11*a*) is the concrete haunch above the girder top flange (10) standard practice in the state of the art concrete deck construction.

Transverse Deck Reinforcement (7*a*) standard practice in the state of the art concrete deck construction.

FIG. 11 is a sectional view of the bridge superstructure at location S4:S4, common for FIG. 6 and FIG. 9.

This section is taken at a vertical plane of Compression Bolts (5) over a girder top flange (10).

Refer to FIG. 1 and FIG. 2 for descriptions of 1,2,3,4,5, 6,7,9,10,11.

Refer to FIG. 10 for descriptions of 1*a*,1*b*,7*a*,11*a*.

FIG. 11 is a sectional view of the bridge superstructure at location S5:S5, common for FIG. 6 and FIG. 9.

This section is taken at a vertical plane of Reinforcing Bar Extensions (4) between two girder top flanges (10).

Refer to FIG. 1 and FIG. 2 for descriptions of 1,2,3,4,5, 6,7,9,10,11.

Refer to FIG. 10 for descriptions of 1*a*,1*b*,7*a*.

Figure 13:
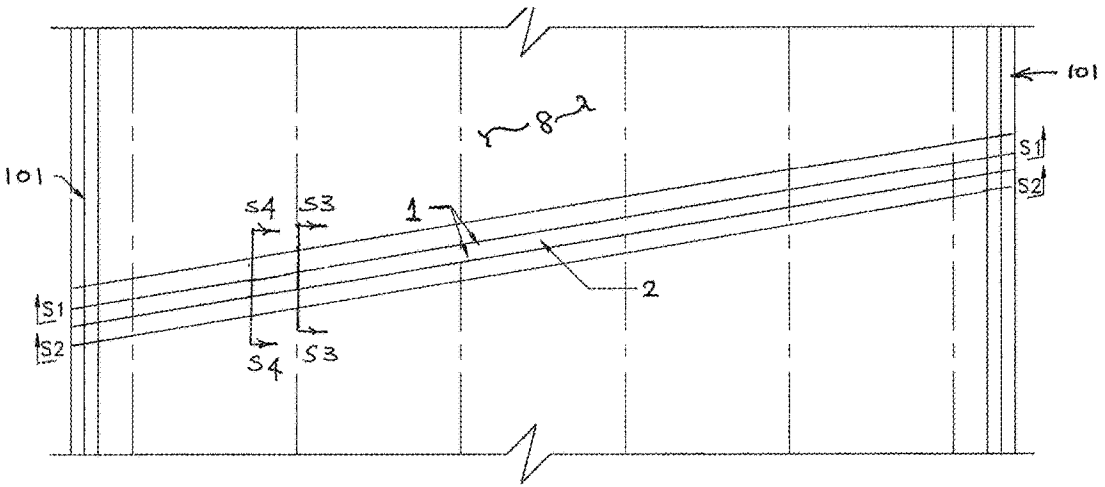
FIG. 13 is a plan view of a bridge deck incorporating the preferred first embodiment of the invention to replace an existing deck joint between decks of adjacent spans of an existing bridge when the entire width of the deck is constructed in a single stage. Only the relevant part of the bridge deck near an intermediate support is presented.

FIG. 13 is a plan view of a bridge deck incorporating the preferred first embodiment of the invention to replace an existing deck joint between decks of adjacent spans of an existing bridge when the entire width of the deck is constructed in a single stage. Only the relevant part of the bridge deck near an intermediate support is presented.

Refer to FIG. 1 and FIG. 2 for description for 1,2,8.

Refer to FIG. 4 for description for 101

Refer to FIG. 3 for description for 15

Figure 14:
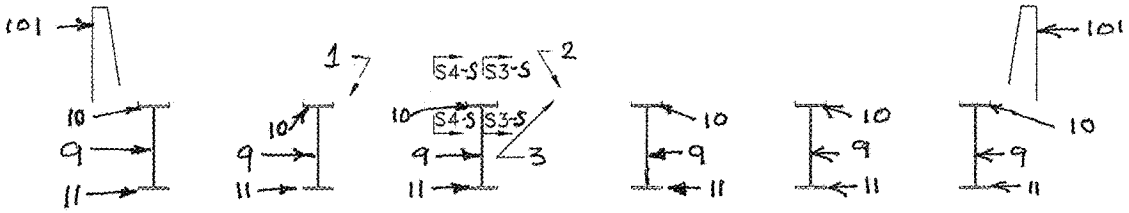
FIG. 14 is a sectional view of the bridge superstructure at location S1:S1 shown in FIG. 13.

Refer to FIG. 14 for section S1:S1

Figure 15:
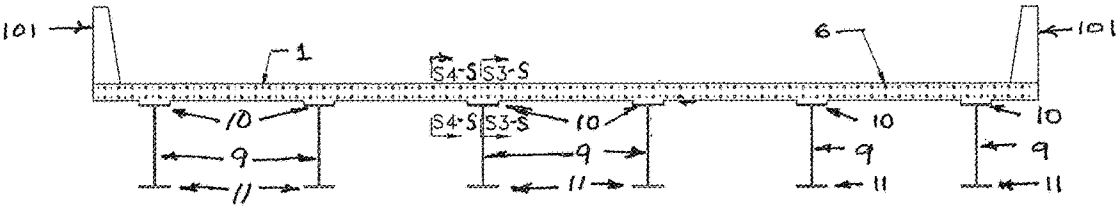
FIG. 15 is a sectional view of the bridge superstructure at location S2:S2 shown in FIG. 13.

Refer to FIG. 15 for section S2:S2

FIG. 14 is a sectional view of the bridge superstructure at location S1:S1 shown in FIG. 13.

Refer to FIGS. 1 and 2 for descriptions of 1,2,3,4,5,6,7, 9,10,11.

Refer to FIG. 4 for description for 101.

Figure 20:
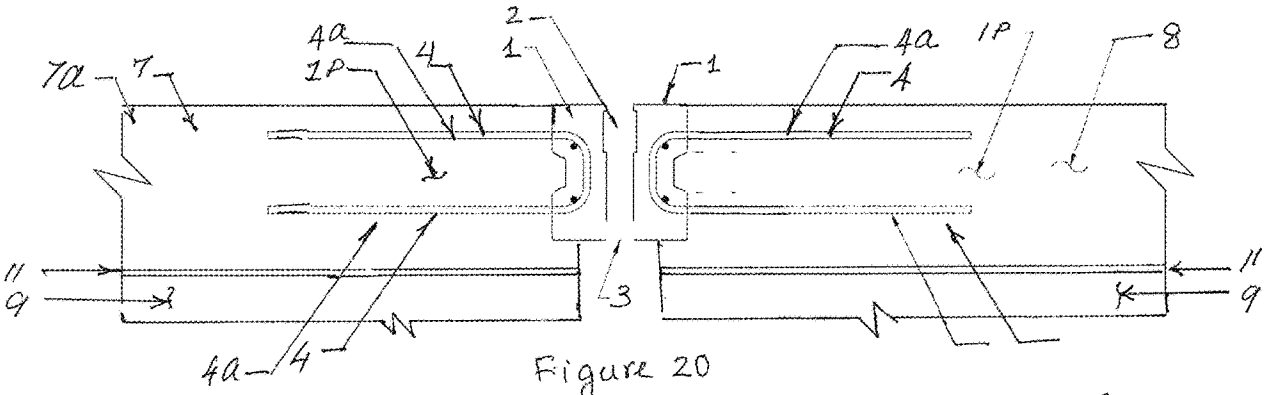
FIG. 20 is a sectional view of the bridge superstructure at location S3-S:S3-S, shown in FIG. 18.

Refer to FIG. 20 for section S3:S3

Figure 21:
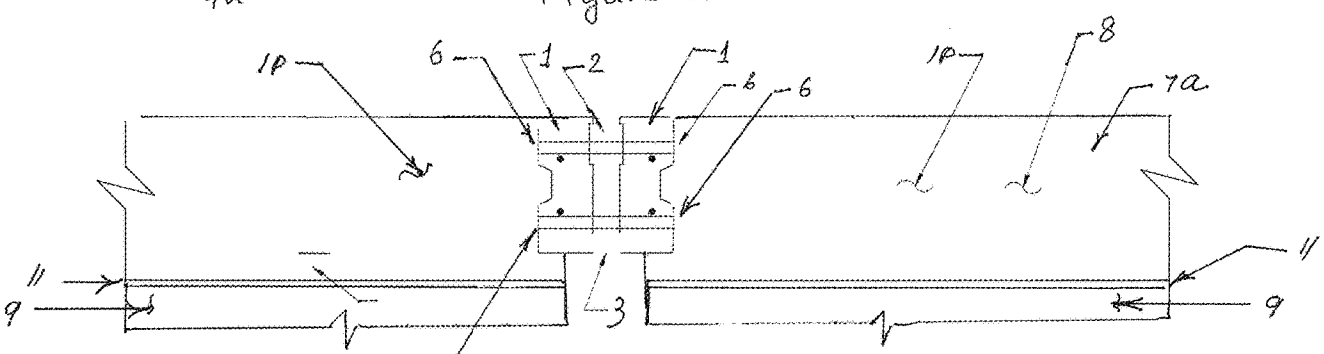
FIG. 21 is a sectional view of the bridge superstructure at location S5-S:S5-S, shown in FIG. 18.

Refer to FIG. 21 for section S4:S4

Figure 19:
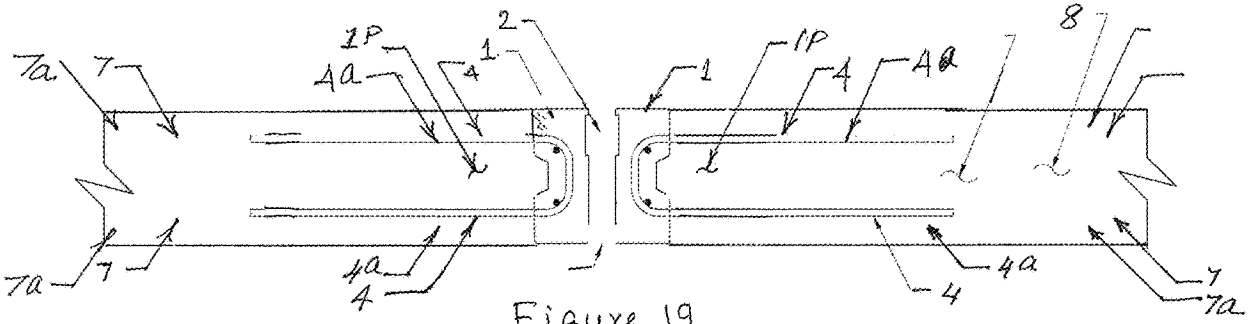
FIG. 19 is a sectional view of the bridge superstructure at location S4-S:S4-S, shown in FIG. 18.

Refer to FIG. 19 for section S5:S5

Figure 16:
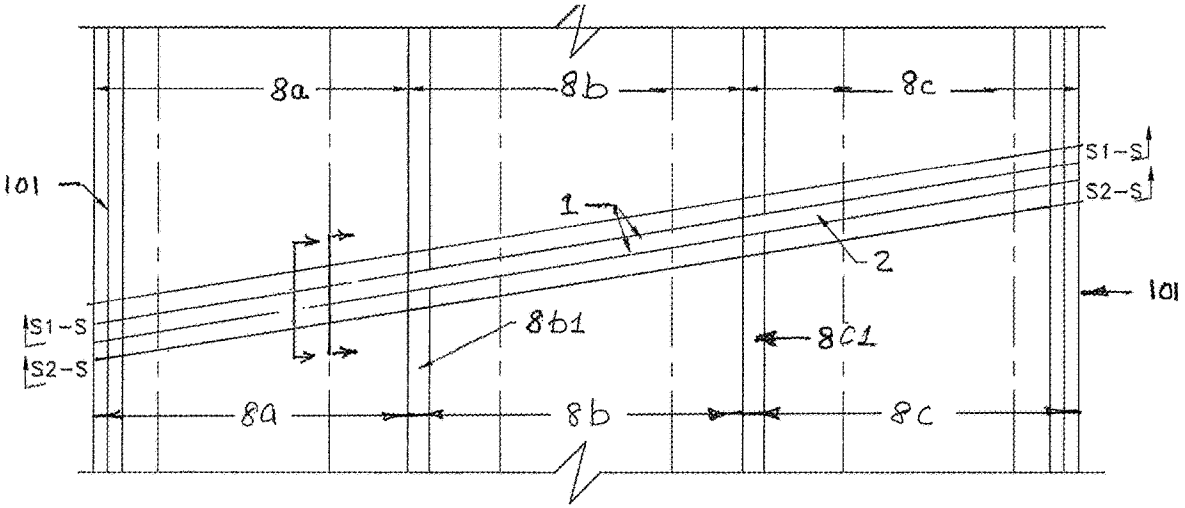
FIG. 16 is a plan view of a bridge deck incorporating the preferred first embodiments of the invention to replace an existing deck joint between decks of adjacent spans of an existing bridge when the entire width of the deck is constructed in three stages. The presentation of a three stage construction sequence is exemplary, the applicability of this invention in a plurality of stages and sequences are implied. Only the relevant part of the bridge deck near an intermediate support is presented.

FIG. 16 is a plan view of the bridge deck incorporating the preferred first embodiment of the invention to replace an existing deck, joint between decks of adjacent spans of an existing bridge when the entire width of the deck is constructed in three stages. The presentation of a three stage construction sequence is exemplary, the applicability of this invention in a plurality of stages and sequences are implied. Only the relevant part of the bridge deck near an intermediate support is presented.

Refer to FIG. 1 and FIG. 2 for description for 1,2

Refer to FIG. 7 for description of 8*a*, 8*b*, 8*c* 8*b*1, 8*c*1

Refer to FIG. 8 for section S1-S:S1-S

Refer to FIG. 9 for section S2-S:S2-S

Figure 17:
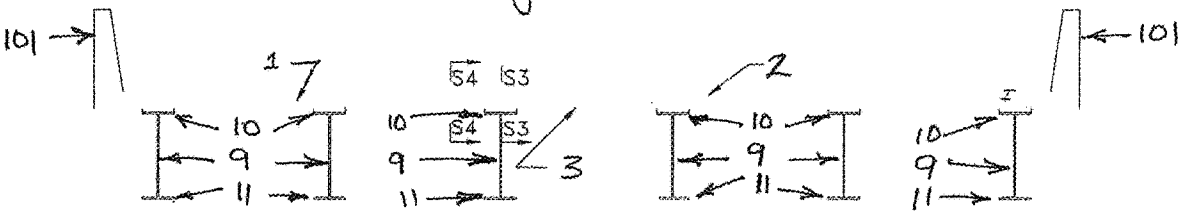
FIG. 17 is a sectional view of the bridge superstructure at location S1-S:S1-S shown in FIG. 16.

FIG. 17 is a sectional view of the bridge superstructure at location S1:S1 shown in FIG. 16.

Refer to FIGS. 1 and 2 for descriptions of 1,2,3,4,5,6,7, 9,10,11.

Refer to FIG. 4 for description for 101.

Figure 18:
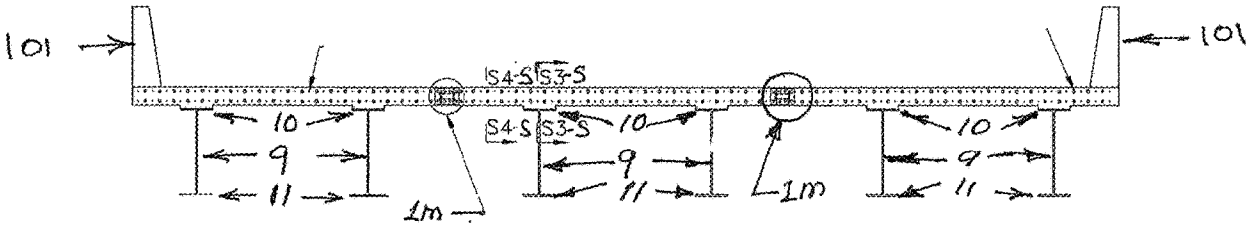
FIG. 18 is a sectional view of the bridge superstructure at location S2-S:S2-S shown in FIG. 16.

FIG. 18 is a sectional view of the bridge superstructure at location S2:S2 shown in FIG. 16.

Refer to FIG. 1 and FIG. 2 for descriptions of 1,2,3,4,5, 6,7,9,10,11.

Refer to FIG. 4 for description for 101.

Refer to FIG. 20 for section S3-S:S3-S

Refer to FIG. 21 for section S4-S:S4-S

Refer to FIG. 19 for section S5-S:S5-S

Refer to FIG. 22 for detail of 1*m*

FIG. 19 is a sectional view of the bridge superstructure at location S5:S5, common for FIGS. 15 and 18

This section is taken at a vertical plane of Reinforcing Bar Extensions (4) between two girder top flanges (10).

Refer to FIG. 1 and FIG. 2 for descriptions of 1,2,3,4,5, 6,7,9,10,11.

Refer to FIG. 10 for descriptions of 1*a*,1*b*,7*a*.

Refer to FIG. 20 for descriptions of 4*a*

FIG. 20 is a sectional view of the bridge superstructure at location S3-S:S3-S shown in FIGS. 15 and 18. This section is taken at a vertical plane of Reinforcing Bar Extensions (4) over a girder top flange (10).

Refer to FIG. 1 and FIG. 2 for descriptions of 1,2,3,4,5, 6,7,9,10,11.

Refer to FIG. 10 for descriptions of 1*a*,1*b*,7*a*,11*a*

Transverse Reinforcement 4*a* is within the closure concrete 15, standard practice in the state of the art closure concrete construction.

FIG. 21 is a sectional view of the bridge superstructure at location S4-S:S4-S common for FIG. 15 and FIG. 18.

This section is taken at a vertical plane of Compression Bolts (5) over a girder top flange (10).

Refer to FIG. 1 and FIG. 2 for descriptions of 1,2,3,4,5, 6,7,9,10,11.

Refer to FIG. 10 for descriptions of 1*a*,1*b*,7*a*,11*a*.

Refer to FIG. 20 for descriptions of 4*a*

FIG. 22 is a detail of location 1*m* shown in FIG. 9 and FIG. 18.

Refer to FIG. 1 and FIG. 2 for descriptions of 1,2,4,5,6

Match cast epoxy joint (mj) is the joint to be installed in the field to enable staged installation of PPJS Connection Hardware 1*mh* is part of the device to apply compression across 1*mj*

Connection bolt and nut (1*mb*) is another part of the device to apply compression across 1*mj* by tightening the nuts against 1*mh*

Connection bolt and nut (1*mc*) is for attaching 1*mh* to 1 on either side of mj and on two 1*a* faces of 1.

BENEFITS OF THE PRESENT INVENTION

Improvements on the First Mode of Joint Failure (1) Required minimum compression in the seal to eliminate the possibility of its separation from the headers is assured by the present invention's capability to induce, measure and adjust the compression in the seal. This improvement is made possible by the use of prefabrication of the joint system. One embodiment of this invention is the thorough bolting system depicted in the FIGS. 1 and 2. Other embodiments of this invention will use a plurality of devices and methods of applying compression, measuring and adjusting.

(2) Undesirably high levels of compression which could result in the squeezing out of the joint seal is also eliminated by measuring and adjusting the compression in the joint at the time of installation.

(3) The total dependence on the chemical bond between the seals and headers for the connection between them in the state of the art practice is being improved upon in the disclosed invention. A plurality of geometric shapes of the header interface will be used to add a mechanical component to the connection.

(4) The surface texture of the header interfaces are achieved using a plurality of production methods afforded by the prefabrication aspect of the invention. This is a significant improvement over the state of the art construction method, enhancing the performance of the chemical bond.

(5) Moisture and undesirable materials will be removed from the connecting surface(s) using a plurality of production methods afforded by the prefabrication aspect of the invention. This also is a significant improvement over the state of the art construction method further enhancing the performance of the chemical bond.

(6) Temperatures at the time of application of the bonding chemical and during the curing time will be maintained within the optimum levels in the disclosed fabrication process further improving the chemical bond.

(7) A plurality of surface geometry of the interface is included in this invention to reduce the exposure of the interface to moisture, chlorides and other chemicals to reduce degradation of the chemical bond at the interface due to adverse environment.

Improvements on the Second Mode of Joint Failure (1) The disclosed method of fabrication and Installation of the joint system cures almost all of the ills associated with the state of the art method of constructing them. Since the fabrication is in a factory setting negatives associated with the time limitations are eliminated. Prefabrication allows ample opportunity for proper inspection and quality control. Any unit that is not meeting the quality standards could either be reworked and improved or replaced with another unit.

(2) Prefabrication will allow sufficient cure time and adequate control of the curing environment thereby producing higher consistent quality header material.

(3) The prefabrication will also allow the use of Ultra High Performance Concrete (UHPC) at a much lower production cost compared to field placed UHPC. Headers made using UHPC have sufficient capacity to resist cracking. The disclosure of using prefabricated UHPC headers for joints is significant advancement over the state of art construction method for joint headers.

DESIGN METHOD FOR PRESENT INVENTION

Design Method for the Joint Seal

The joint seal is designed based on the bridge type, geometry, superstructure type, and the design temperature range applicable for the specific bridge so that the seal can be compressed at the time of installation so that the required minimum compression is assured at maximum joint opening and the allowable maximum compression is not exceed at the minimum joint opening.

Design Method for the Joint Seal Compression

A plurality of systems will be used to impart the computed level of pre compression into the joint seal through the UHPC headers prior to installation in the field. The compression bolting system The bolting system is one embodiment of the above invention. The designs of these systems will allow field adjustment in the compression of the seal before installation. The designs will also allow uninhibited temperature related movement of the bridge superstructure.

The novel design methods disclosed above will rectify shortcomings identified and explained in the description of prior art.

Design Method for the Joint Headers

Joint headers will be custom designed based on the condition and capacity of the component supporting the joint system. Movement of the joint headers under live load will be considered in the design and will be robust enough to resist cracking under service condition. This significant improvement over the state of the art construction of bridge deck joint systems.

FABRICATION METHOD FOR PRESENT INVENTION

The fabrication of the PFDS will be conducted in a factory environment under controlled climate.

Fabrication Method for the Joint Seal

The joint seal durable enough to perform the design functions for the intended service life of the specific application will be selected and utilized in the fabrication process and as per the design developed under the design method for the joint seal. The seal material will have material properties that will assure adequate performance for the design service life of the bridge deck joint.

Fabrication Method for the Joint Headers

The casting and curing of the headers will be according to the standards used in the precast UHPC products components and as per the design developed under the design method for joint headers. The headers will be bonded to the Joint Sealer with a proprietary bonding detail and bonding agent.

The bolting system or other devices or methods of applying compression will be produced using materials and designs which will be capable of providing the design functions of the system. The system will be capable of a low maintenance service life.

The invention claimed is:

1. A method for manufacturing a prefabricated pre-compressed bridge deck joint system enabling temperature cycle movement, comprising in a controlled environment, providing a plurality of concrete joint headers;

in the controlled environment, providing joint sealer between the plurality of concrete joint headers; and in the controlled environment, pre-compressing the joint sealer between the plurality of concrete joint headers such that the joint sealer maintains compression through a temperature cycle.

2. The method for manufacturing of claim 1, wherein the pre-compressing comprises pre-compressing the joint sealer between the plurality of concrete joint headers such that the joint sealer maintains a required minimum compression at a maximum joint opening state of the prefabricated pre-compressed bridged deck joint system.

3. The method for manufacturing of claim 1, wherein the pre-compressing comprises pre-compressing the joint sealer between the plurality of concrete joint headers such that the joint sealer maintains a maximum compression at a minimum joint opening state of the prefabricated pre-compressed bridged deck joint system.

4. The method for manufacturing of claim 1, wherein the pre-compressing comprises pre-compressing the joint sealer between the plurality of concrete joint headers such that the joint sealer maintains both a required minimum compression at a maximum joint opening state of the prefabricated pre-compressed bridged deck joint system, and a maximum compression at a minimum joint opening state of the prefabricated pre-compressed bridged deck joint system.

5. The method for manufacturing of claim 4, wherein the pre-compressing comprises pre-compressing the joint sealer in consideration of bridge type, geometry, superstructure type, and design temperature range.

6. The method for manufacturing of claim 4, further comprising:

providing a blocking member adjacent to the joint sealer before the pre-compressing.

7. The method for manufacturing of claim 4, further comprising:

providing a plurality of compression bolts extending from sides of the plurality of concrete joint headers;

providing a plurality of compression inducing nuts attached to the plurality of compression bolts, wherein the pre-compressing comprises adjusting the plurality of compression inducing nuts along the plurality of compression bolts.

8. The method for manufacturing of claim 1, wherein the providing of the plurality of concrete joint headers includes forming the plurality of concrete joint headers from Ultra High Performance Concrete (UHPC).

* * * * *